United States Patent [19]

Tomasi-Dubois

[11] Patent Number: 5,014,356

[45] Date of Patent: May 14, 1991

[54] DROPSEAT JUMPSUIT

[76] Inventor: Mary J. Tomasi-Dubois, 121 Altura Vista, Los Gatos, Calif. 95030

[21] Appl. No.: 407,350

[22] Filed: Sep. 14, 1989

[51] Int. Cl.[5] ..... A41D 1/06

[52] U.S. Cl. ..... 2/79

[58] Field of Search ..... 2/79, 78 R, 78 B, 247, 2/71, 78 C, 78 D, 76

[56] References Cited

U.S. PATENT DOCUMENTS 1,634,829 7/1927 Halperin ..... 2/79
2,389,273 11/1945 Novak ..... 2/79
3,949,427 4/1976 Sampey ..... 2/79
4,535,480 8/1985 Kunieda ..... 2/79

*Primary Examiner*—William A. Cuchlinski, Jr.
*Assistant Examiner*—William C. Dowling
*Attorney, Agent, or Firm*—John J. Leavitt

[57] ABSTRACT

A jumpsuit with an improved, utilitarian dropseat having a bodice attached to pants at the front waist seam. The pants have hidden, in-seam side pockets that facilitate the opening of the dropseat area. The dropseat area has a back, elasticized waistband and side tabs having fasteners that, when fastened, secure the dropseat in closed position with the appearance of a normal jumpsuit.

7 Claims, 10 Drawing Sheets

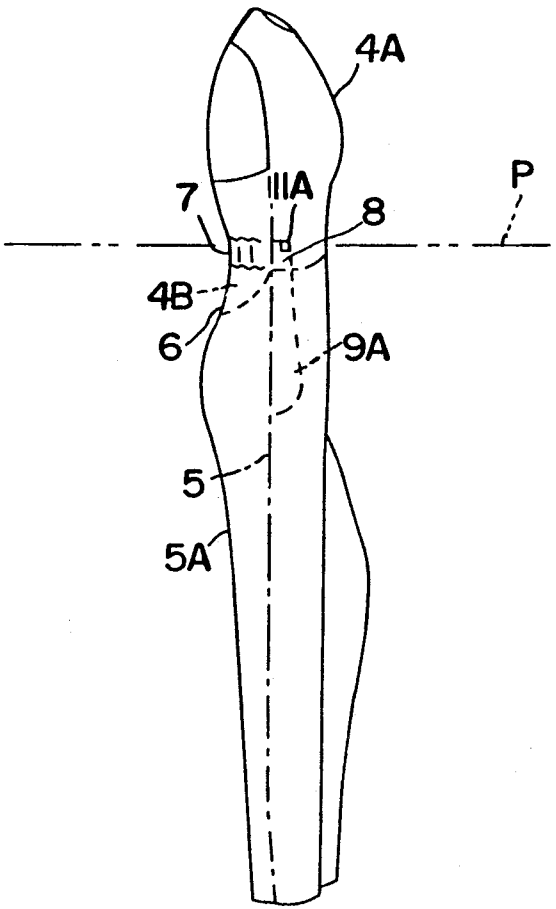
FIG. IB
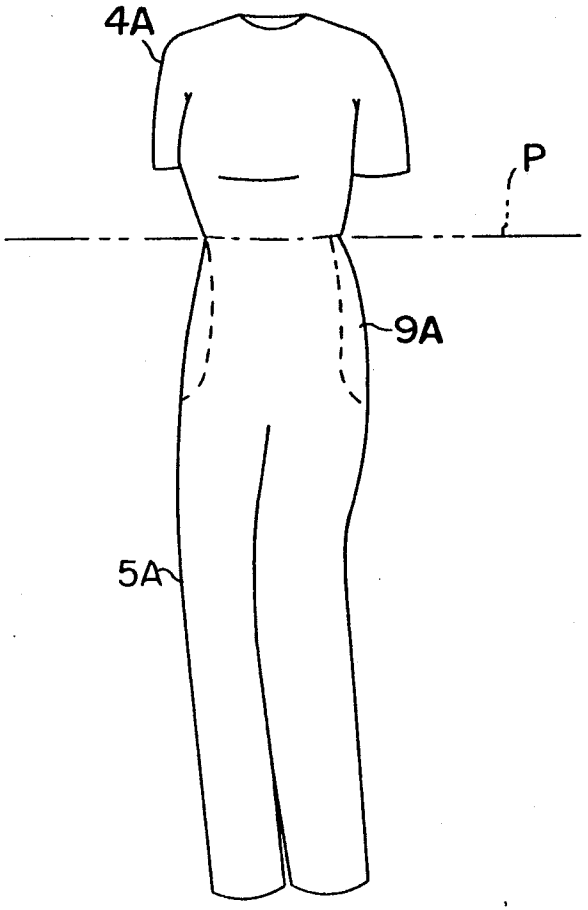
FIG. IA

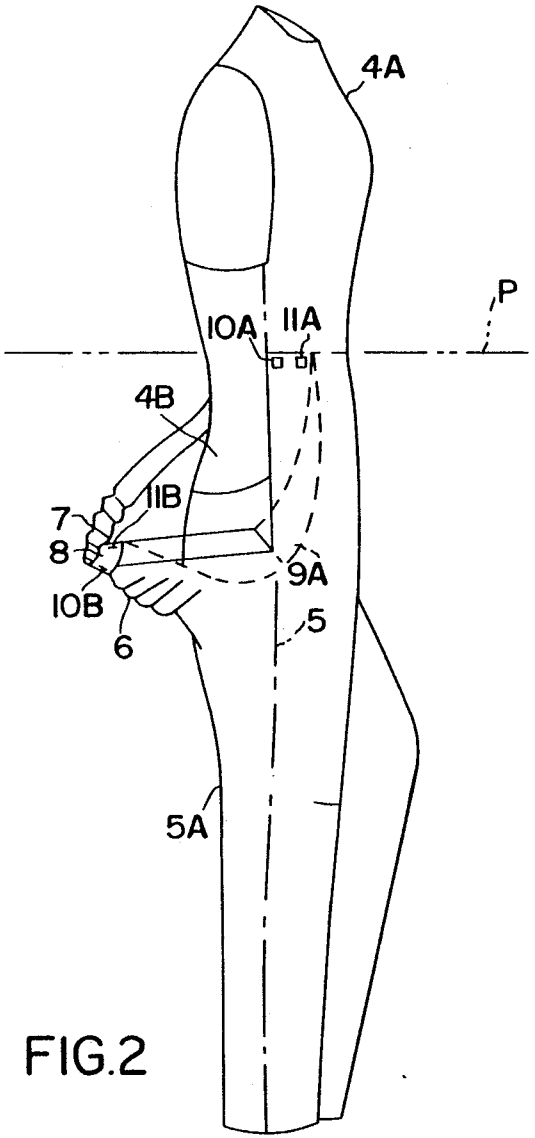
FIG.2
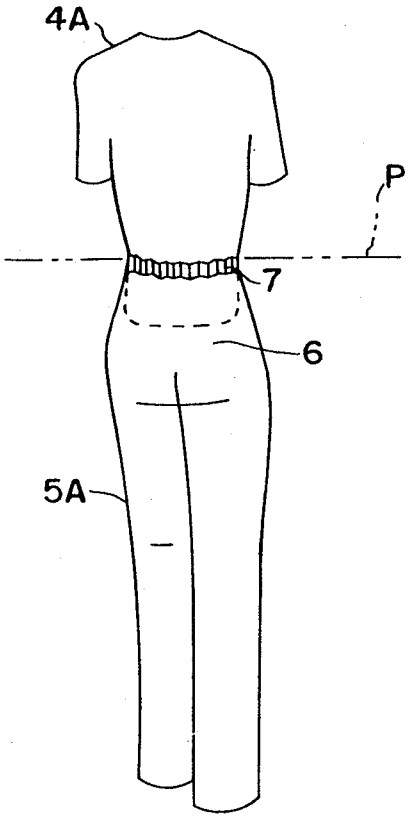
FIG.IC

DROPSEAT JUMPSUIT

BACKGROUND OF THE INVENTION

1. Field of the Invention

This invention relates to jumpsuits, specifically to an improved utilitarian dropseat in a jumpsuit.

2. Description of the Prior Art

Known prior art includes the following U.S. Pat. Nos.:

| | | |
|---|---|---|
| 1,547,457 | 1,561,545 | 1,634,829 |
| 2,284,953 | 2,357,532 | 2,368,034 |
| 2,389,273 | 2,611,132 | 2,849,717 |
| 3,088,116 | 3,852,824 | 3,949,427 |
| 3,994,026 | 4,447,911 | 4,457,025 |
| 4,535,480 | 4,607,396 | |

While jumpsuits have always been desirable and "easy to wear" articles of clothing for women, undressing to use the toilet has made them inconvenient. Heretofore, to solve this problem, a dropseat was used to provide an opening for toilet use. However, the opening was not wide enough to render it useful, and a self-belt tie was used to close the dropseat, destroying the "line" of the jumpsuit and making it uncomfortable to wear by drawing the crotch up too high, defeating the reason women buy them in the first place. Additionally, the self-ties are long and frequently fall on the floor or toilet seat, exactly the kind of incident women want to avoid in a public restroom.

Accordingly, several objects and advantages of my invention are:

a) to provide a jumpsuit that is comfortable, easy to wear and provides the symmetry of the normal jumpsuit without the inconvenience of undressing to use the toilet;

b) to provide a jumpsuit with hidden, in-seam side pockets which facilitate the opening of the dropseat, allowing it to open wide enough to accomplish its purpose;

c) to provide a jumpsuit utilizing an elasticized, back waistband which holds the dropseat in place close to the waist when closed, rendering it undetectable;

d) to provide a jumpsuit with tabs attached to the dropseat waistband which become the side waistband portions and are hidden from view when fastened so as to create an unbroken line and the look of a normal jumpsuit; and e) to provide a dropseat with attached side tabs for fastening which are not bulky or cumbersome and do not get in the way or drop on the floor.

Further objects and advantages are to provide a jumpsuit with an easy to use and easy to fasten dropseat.

BRIEF DESCRIPTION OF THE DRAWINGS

In the drawings, closely related figures have the same number but different alphabetic suffixes.

FIG. 1A illustrates a front perspective view of the jumpsuit, which has the appearance of a conventional jumpsuit.

FIG. 1B illustrates a side perspective view of the jumpsuit, indicating the in-seam side pocket and back waistband, with side tabs attached to the dropseat. This view shows how the jumpsuit looks when the dropseat is fastened at the waist.

FIG. 1C illustrates a back perspective view of the jumpsuit with the elasticized, back waistband holding the dropseat up close to the body resulting in the look of a normal jumpsuit.

FIG. 2 is a side perspective of the jumpsuit showing the dropseat unfastened and open. The shirttail of the bodice is indicated, showing it long enough to "tuck" into the elasticized waistband of the dropseat. This figure also illustrates the in-seam side pockets and how they facilitate a wide enough opening for the dropseat to be functional.

REFERENCES ON THE DRAWINGS

Figure 3:
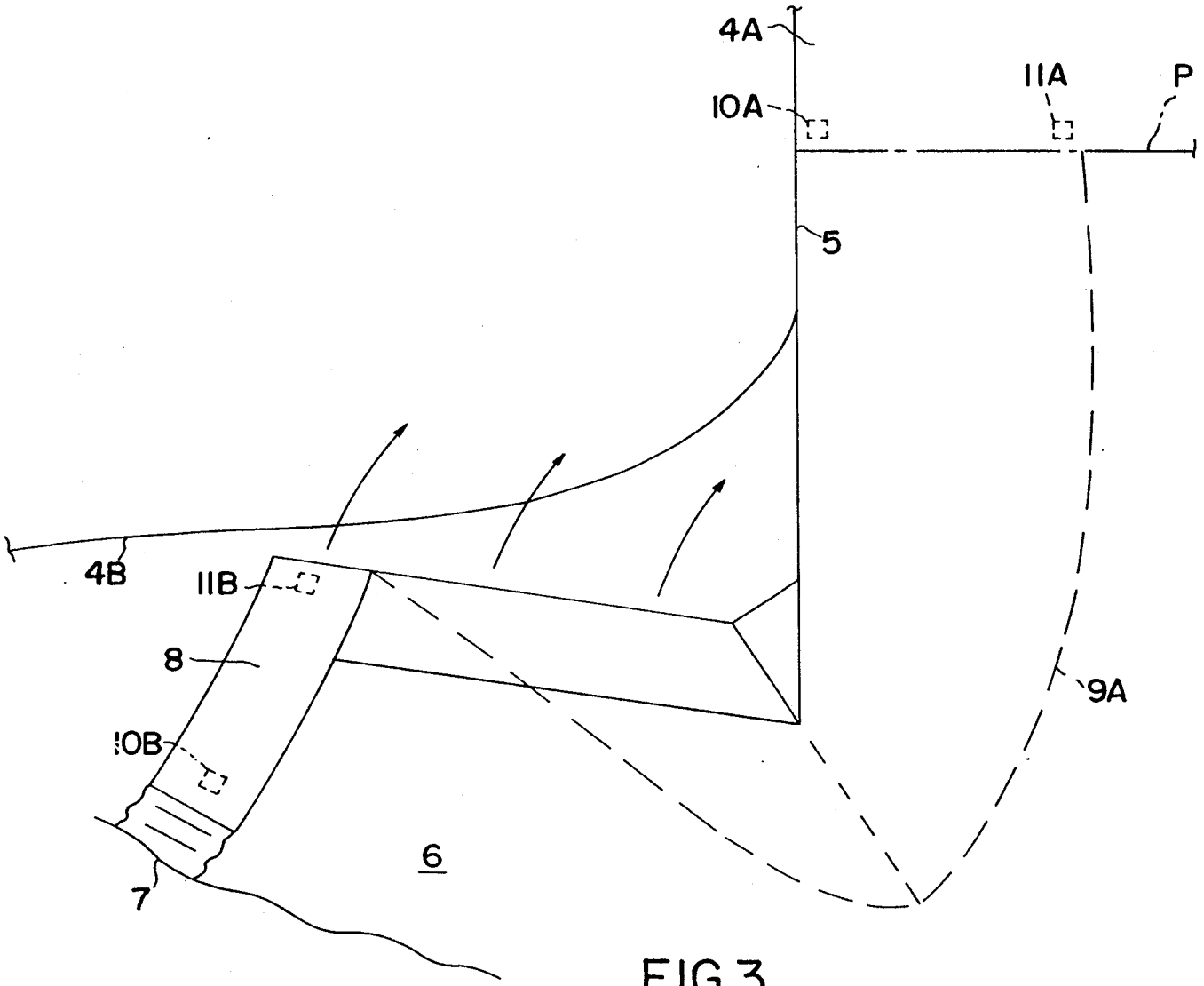
FIG. 3 is an enlarged fragmentary view partly in perspective of the in-seam side pocket, tab for fastening, and fasteners.

P Waistband Plane
4A Jumpsuit Bodice
4B Bodice Shirtail
5 Side seam
5A Jumpsuit Pants
5B Hem of Jumpsuit Pants
6 Dropseat Area of Jumpsuit
6A Side edge of dropseat
6B Lowermost point of side edge 6A
6C Stitching
6D
6E Free flap edge
7 Back Elasticized Waistband
8 Side Tab
9A In-seam Side Pocket
9B Bottom Edge of in-seam Side Pocket (FIG. 9)
10A First Fastener, one-half at Waist Area of Bodice (Same Both Sides)
10B First Fastener, other half at Tab (Same Both Sides)
11A Second Fastener, one-half at Waist area of Bodice (Same Both Sides)
11B Second Fastener, other half at Tab (Same Both Sides)
12A Flap of Pocket (9A)
12B Top of Flap (12A)
12C Large Dot on Flap (12A)
13A Flap of Pocket (9A)
13B Top of Flap (13A)
13C Large Dot on Flap (13A)
13D Small Dot on Flap (13A)
13E Small Dot on Flap (13A)
14 Back Leg of Jumpsuit Pants (5A)
15 Front Leg of Jumpsuit Pants (5A)

DESCRIPTION OF THE PREFERRED EMBODIMENT

A typical embodiment of my improved dropseat jumpsuit, with dropseat closed, is illustrated in FIG. 1A (front view) showing that it looks like a conventional jumpsuit with bodice 4A, pants 5A having a side seam 5, and in-seam side pockets 9A which, as illustrated, extend forwardly of the side seam 5 and a substantial distance below the waistband plane P. In FIG. 1B, the jumpsuit bodice shirttail 4B is tucked into the elasticized, back waistband 7 of the dropseat portion 6, again giving the impression of a conventional jumpsuit and again showing the in-seam side pockets extending forwardly of seam 5. In FIG. 1C, a back view of the jumpsuit is illustrated showing the elasticized, back waistband 7 and dropseat portion 6 fastened and in place and undetectable. FIG. 2 illustrates the dropseat construction in substantially more detail, showing the jumpsuit bodice 4A with shirttail 4B that extends below the waistband plane P, and jumpsuit pants 5A with dropseat portion 6 that has an attached, elasticized back waistband 7 and side tabs 8. The jumpsuit has in-seam side pockets 9A that are fully contained when the dropseat is closed as shown in FIGS. 1A and 1B, within the front part of each pant leg forwardly of the side seam 5. As shown in FIG. 1A, the bottom of the pocket is at about the level of the crotch of the jumpsuit pants, with one part of the pocket, i.e., that layer or segment of cloth that lies closest to the wearer's body, also forming an extension of the dropseat and having its upper end edge defined by the tab 8. Below or from the tab 8, of which it is an integral part, this inner pocket part extends downwardly and inwardly away from the seam line 5, to be joined to associated peripheral edges of the outside pocket part or layer which lies adjacent the inner surface of the front leg portion of the pant leg. One edge portion of this outside pocket part is sewn to the pant leg along the seam line 5 in such a manner that when the drop seat is closed, a hand may be inserted through the opening along the seam line 5 and between the inner and outer pocket parts as shown in the drawings.

FIG. 3 is an enlarged view with the dropseat portion 6 down. Side tab 8 is shown with fasteners 10B and 11B that fasten to the fasteners 10A and 11A in the jumpsuit bodice 4A at the waist. It is clear from this view, particularly when viewed with FIGS. 9 and 10, that the "pocket" that is formed is formed partially by the flap 12A (FIGS. 9 and 10) sewn as shown to the waistband of the bodice and suspended inside and adjacent to the inside surface of the associated leg portion of the jumpsuit. One long depending edge of this flap 12A is sewn along the seam line 5, while the opposite edge of this flap 12A remains free of attachment to the underlying front leg portion. The remaining portion of the "pocket" is formed by the flap 13A (FIGS. 9 and 10) that is defined by the tab 8 across the top that forms, as shown, a non-elastic extension of the elastic portion 7 of the waistband, and is sewn along one edge to the associated side edge 6A of the dropseat 6, the stitching continuing downwardly as shown to the point 6B, which constitutes the lowermost point of the dropseat edge 6A. But, the two pocket flaps 12A and 13A continue downwardly beyond the point 6B, and the bottom end edges of the two flaps 12A and 13A are sewn as shown by the stitching 6C, which extends around the curved bottom end edge portions of the pocket flaps to the point 6D along free flap edge 6E.

Thus, when the dropseat is closed, as seen in FIG. 1B, both pocket flaps 12A and 13A extend forwardly of the seam line 5 (FIGS. 1B and 3), the entrance to the pocket is through the separation parallel to the seam line 5 of the juxtaposed edges of the pocket flaps 12A and 13A, the latter being sewn to the associated edge 6A of the dropseat defined by the termination point of the elastic waistband and the point 6D while the former is sewn along a corresponding edge along the seam line 5 to the front leg portion below the waistband.

Figure 9:
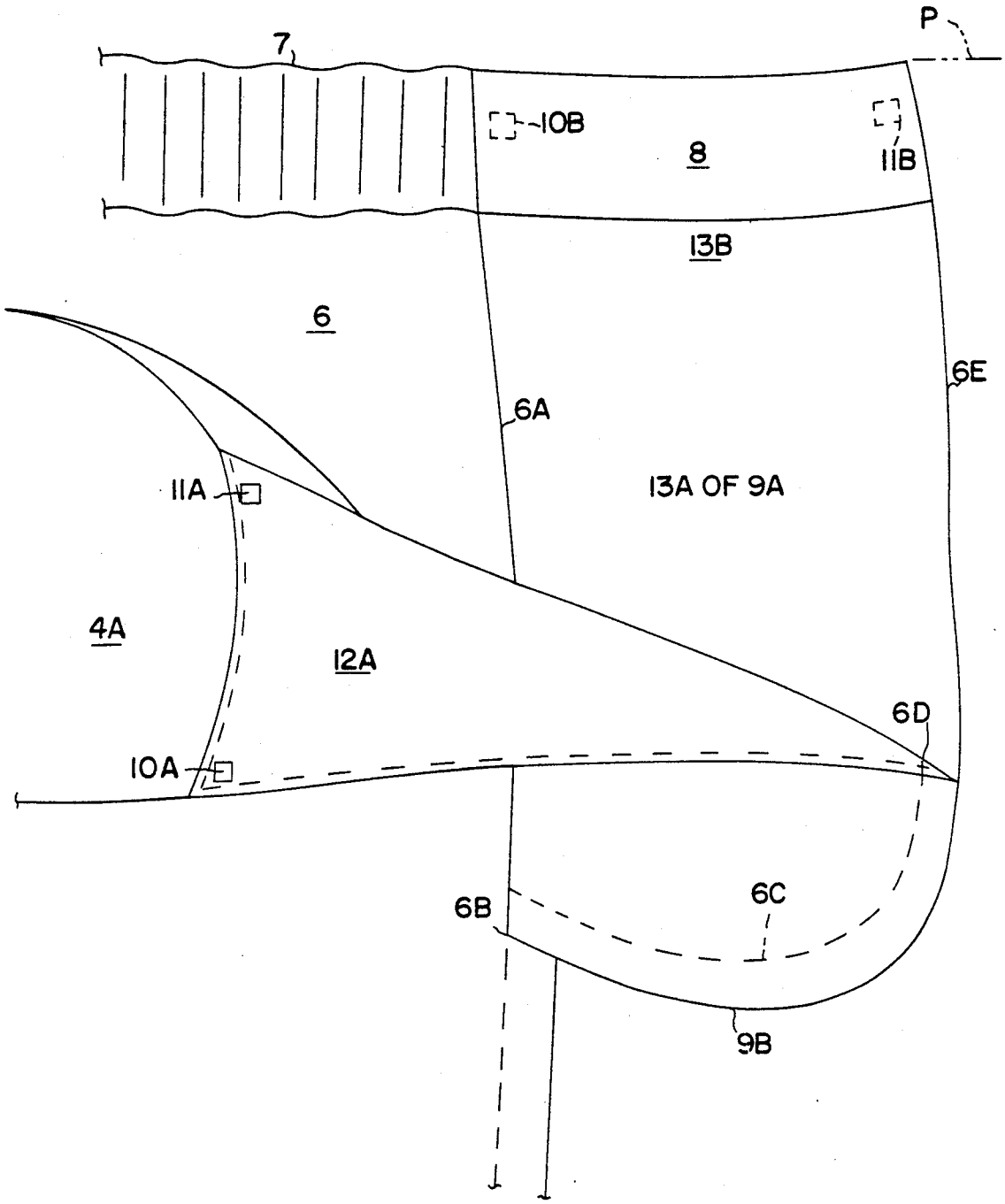
Figure 10:
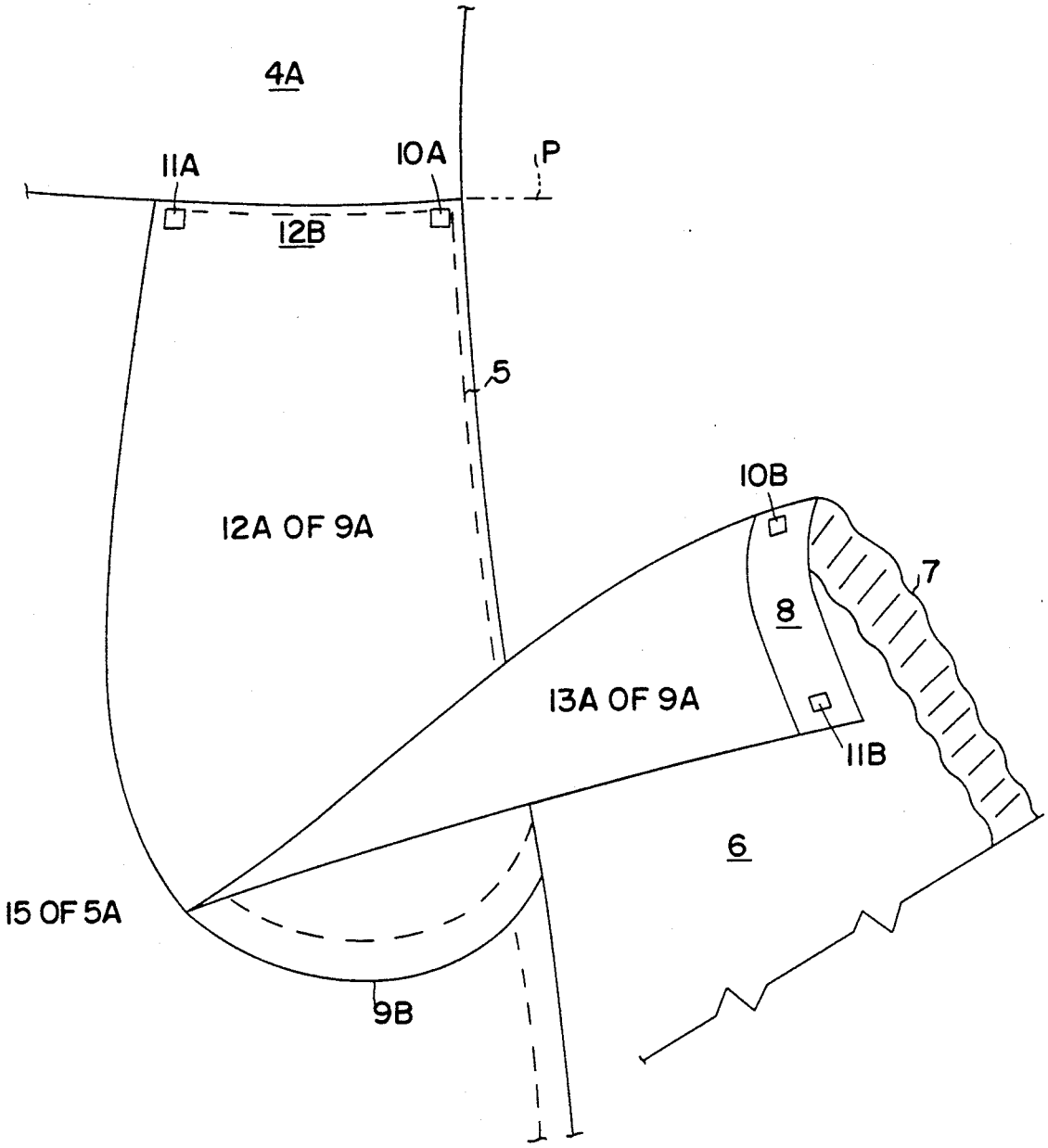

Clearly, then, referring to FIGS. 3, 9 and 10, when the dropseat is closed, the "free" edge 6E of the dropseat extension flap 13A extends circumferentially inwardly and forwardly beyond the seam line 5, and the fastener element 11B on the free corner of the flap 13A is detachably engaged to the complementary fastener element 11A which is attached to the bodice waistband circumferentially inwardly and forwardly of the seam line 5.

This results in the pocket flap 13A overlapping and lying parallel to the pocket flap 12A. In this relationship, the fastener element 10B positioned on the tab 8 on or adjacent to seam line 6A coincident with the side edge of the dropseat and the termination point of the elastic waistband 7 is detachably secured to the complementary fastener element 10A mounted on the bodice at the seam line 5, and the opening to the pocket is along the seam line 5 between the fasteners 10A-10B at the top and the point 6B at the bottom.

When the dropseat is opened, it will be seen that the flaps 13A and attached dropseat drop away from the bodice waistband, the flap extensions substantially enlarging the opening as the "free" edges 6E of the flap 13A pulls the inside corner 6D of the pocket outwardly beyond the seam line 5 as shown in FIGS. 3 and 9.

Figure 4:
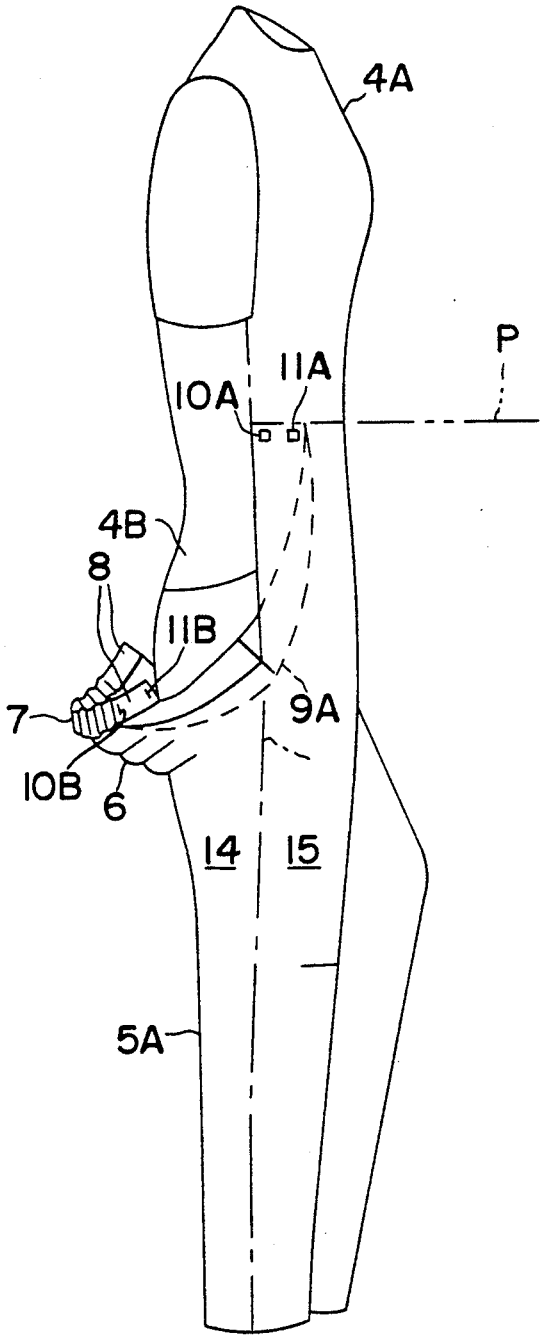
FIG. 4 is a perspective view similar to FIG. 1B and showing the fasteners unfastened, allowing the dropseat to open wide enough to be functional.
Figure 5:
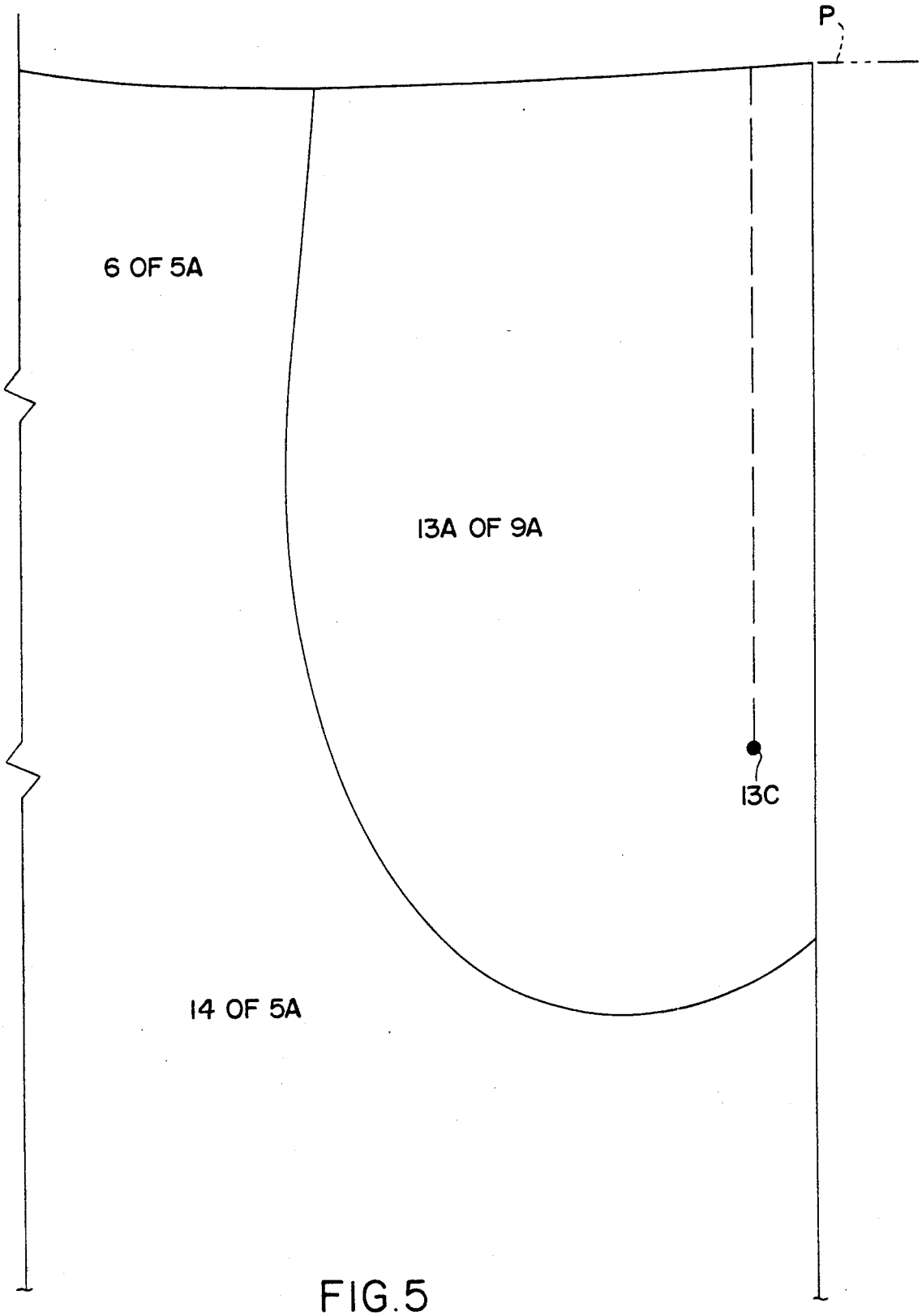
FIGS. 5 through 10 are enlarged fragmentary views showing the construction of the in-seam side pocket.

FIG. 4 shows a side view of the jumpsuit with the fasteners 10A, 10B, 11A and 11B unfastened, and the dropseat 6 open wide enough to be functional.

FIGS. 5 through 10 show the construction details of the in-seam side pockets, that will be very clear to a pattern maker for the garment.

OPERATION

When the side tabs 8 are fastened, utilizing the fasteners 10A–10B and 11A–11B, the dropseat area 6 is undetectable as illustrated in FIGS. 1A, 1B and 1C. To lower the dropseat, one would simply "undo" the first fastener 10A and 10B first, then slide the right hand, for the right side and left hand for the left side, into the inside waistband area of the jumpsuit bodice 4A, closest to the body, and "undo" the second fastener 11A and 11B. Then this procedure would be repeated for the other side of the garment. When both sides are unfastened, the dropseat area 6 is free to fall as illustrated in FIGS. 2 and 4.

The construction of the in-seam side pockets 9A aids the dropseat area 6 in opening wide enough to be functional, as illustrated in FIG. 4 for the reasons previously explained. Without the utilization of the pocket construction, the dropseat area 6 would open, but not enough to be useful.

FIGS. 5 through 10 illustrate the construction of the in-seam side pockets 9A. Flap 13A of in-seam side pocket 9A is sewn to the back leg 14 of the jumpsuit pants bottom 5A at the dropseat area 6 with right sides together to large dot 13C only, FIG. 5.

Figure 6:
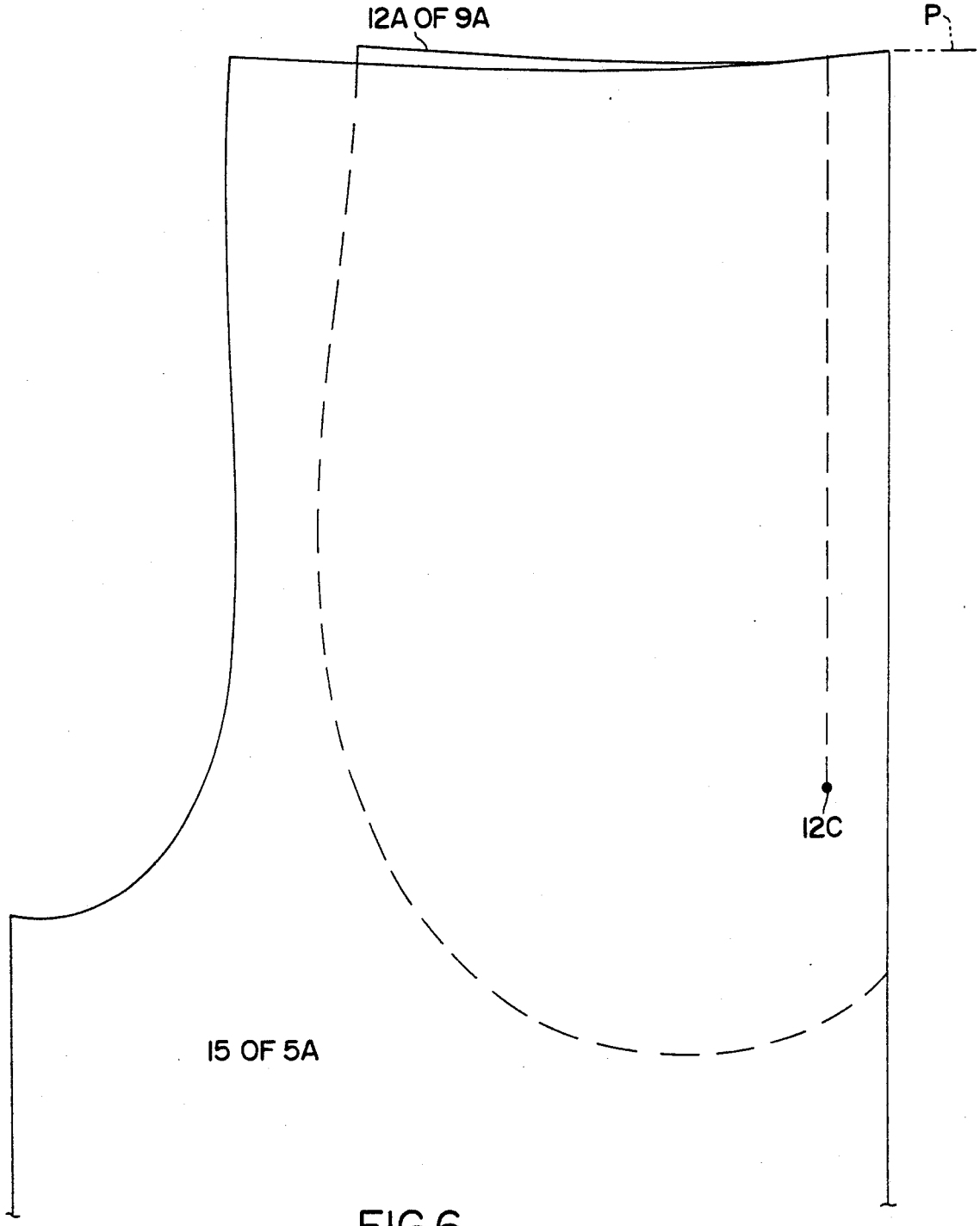
Figure 7:
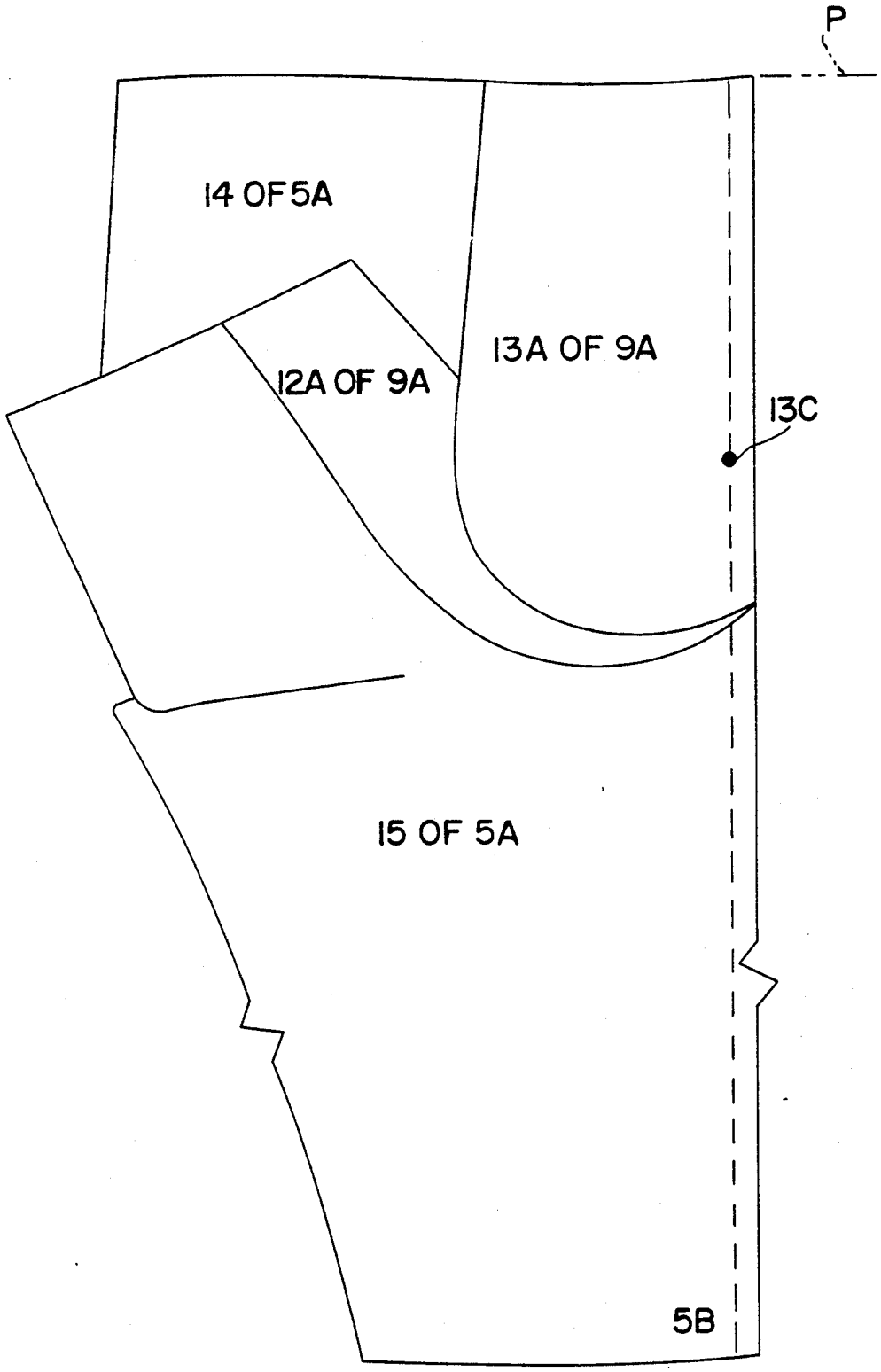
Figure 8:
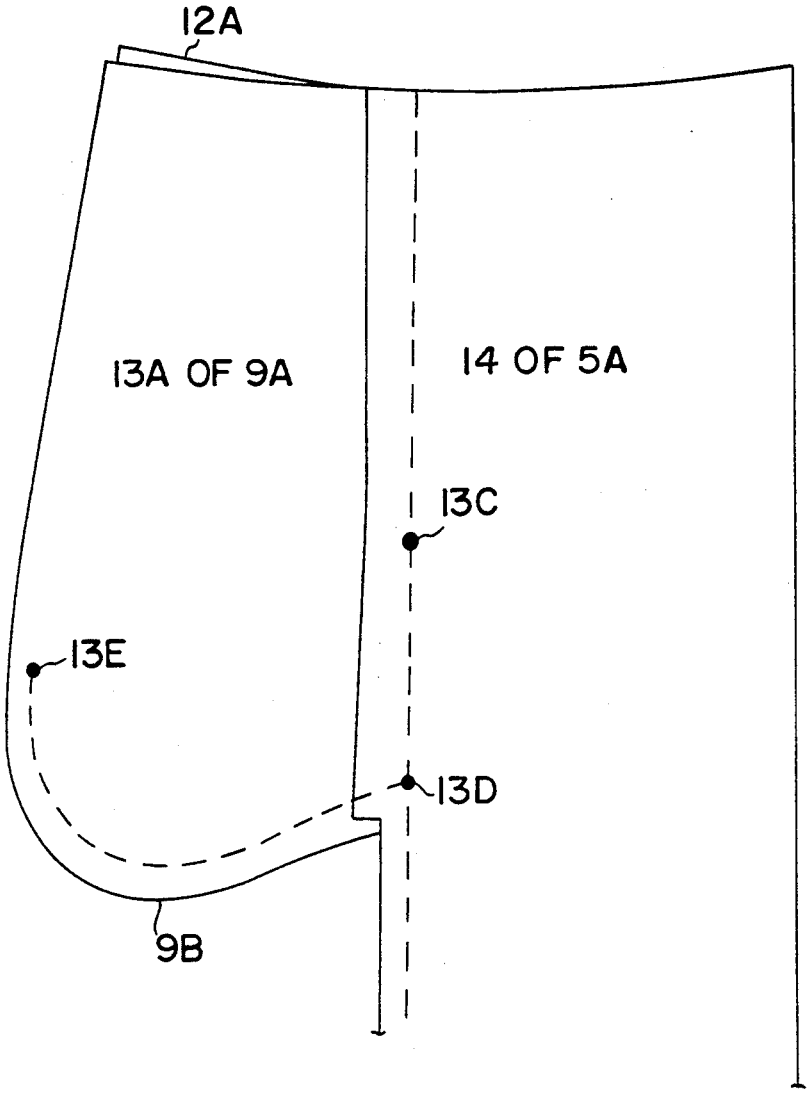

Flap 12A of in-seam, side pocket 9A is sewn to the front leg 15 of jumpsuit pants bottom 5A with right sides together to large dot 12C only, FIG. 6. The side seams of the back leg 14 and front leg 15 of the jumpsuit bottom 5A are sewn together from the large dot 13C of flap 13A of the in-seam, side pocket 9A to the bottom leg hem 5B, FIG. 7. The bottom edges 9B of the in-seam side pocket 9A are sewn together from small dot 13D to samll dot 13E, FIG. 8. The top 13B of flap 13A of in-seam side pocket 9A is sewn to side tab 8, FIG. 9. The top 12B of flap 12A of in-seam side pocket 9A is sewn to the waist at the front leg 15 where the jumpsuit bodice 4A joins the jumpsuit pants 5A with wrong sides together, FIG. 10. The same procedures are repeated for the other side.

SUMMARY

Accordingly, it will be seen that the side tabs, hidden when fastened, the pocket construction, and the elasticized, back waistband all work together to form a unique, functional, utilitarian garment that is:

a) comfortable, easy to wear, and provides the symmetry of the normal jumpsuit without the inconvenience of undressing to use the toilet;

b) a jumpsuit with hidden, in-seam side pockets which facilitate the opening of the dropseat, allowing it to open wide enough to accomplish its purpose;

c) a jumpsuit utilizing an elasticized, back waistband which holds the dropseat in place close to the waist when closed, rendering it undetectable;

d) a jumpsuit with tabs attached to the dropseat which become the side waistband, and are hidden from view when fastened, to create an unbroken line and the look of a normal jumpsuit; and e) a dropseat with attached side tabs for fastening which are not bulky or cumbersome and do not get in the way or drop on the floor.

This unique design does not limit the style of the jumpsuit. On the contrary, a multitude of bodices and leg styles could be used, as well as different materials to produce functional sportswear, uniforms, and evening wear.

Thus, the scope of the invention should be determined by the appended claims and their legal equivalents, rather than by the examples given.

I claim:

1. In an article of clothing in the nature of a one-piece jumpsuit including a bodice having a waist front and a back including a shirttail that extends below the waist front, and pants having a front portion attached to said waist front and depending from said bodice, the improvement comprising:

a) a dropseat panel having a transverse waistband portion intercepted by lateral side edges forming a back portion of said pants shiftable between closed and open positions and normally detachably secured to the waist front of said bodice when said dropseat is in closed position; and b) means interposed between said dropseat and said front portion of said pants cooperating to form a utility pocket within the front portion of said pants accessible along a lateral side edge of said dropseat when it is in closed position and cooperating with said dropseat to enlarge the opening normally covered by said dropseat when said dropseat is detached from said waist front.

2. The article of clothing according to claim 1, wherein the waistband portion of said dropseat panel is elasticized.

3. The article of clothing according to claim 1, wherein the waistband portion of said dropseat panel is of predetermined length defined by opposite terminal ends, at least one fastener element mounted adjacent each terminal end of said dropseat waistband portion, a complementary fastener element mounted on said waist front on each side thereof for selective detachable engagement with the fastener element on said dropseat waistband, a pair of flaps disposed between said dropseat panel and said front pant portion in juxtaposed relationship to form said utility pocket when said dropseat is closed and extended into non-juxtaposed relation when said dropseat is open.

4. The article of clothing according to claim 3, wherein one flap of said pair of flaps comprises a lateral extension of said dropseat panel from an associated lateral side edge thereof whereby when said dropseat is closed said lateral extension flap extends forwardly and circumferentially to overlap the other flap of said pair thereof and overlap said front pant portion, and detachable fastener means cooperatively disposed between the distal edge portion of said lateral extension flap and said waist front spaced forwardly and circumferentially from said first mentioned complementary fastener element on said waistband portion of said bodice.

5. The article of clothing according to claim 4, wherein said pair of flaps comprise elongated panels each having opposite elongated side edge portions and opposite relatively narrower end edge portions, one end edge portion of one of said flaps being juxtaposed and sewn to the corresponding end edge portion of the other flap of the pair while the opposite end edge portion of one of said flaps is sewn to said bodice and the corresponding end edge portion of the other flap comprises a lateral extension of said dropseat panel, one elongated edge portion of said one of said flaps sewn to said bodice being sewn to said front pant portion, while one elongated edge portion of said other flap is sewn to the lateral side edge of said dropseat panel to form a lateral extension thereof lying juxtaposed to said one of said flaps when the dropseat is closed and extended into non-juxtaposed relation when said dropseat is open.

6. The article of clothing according to claim 5, wherein selectively engageable and disengageable fastener means are operatively disposed at the intersection between the distal edge portion of said flap sewn to said dropseat lateral side edge and the end edge thereof and on said waist front spaced circumferentially forwardly from the sides of said bodice whereby when said fastener means are engaged corresponding end edge portions of said flaps are juxtaposed at said bodice waistband.

7. The article of clothing according to claim 6, wherein said detachable fastener elements lie in a common plane coincident with said front waist and said waistband when said dropseat is closed.

* * * * *